US012402726B1

(12) United States Patent
Connors et al.

(10) Patent No.: US 12,402,726 B1
(45) **Date of Patent: *Sep. 2, 2025**

(54) SHELF DEVICE WITH INTERCHANGEABLE FACEPLATE

(71) Applicants: Frank R. Connors, The Villages, FL (US); Caroline M. Connors, The Villages, FL (US)

(72) Inventors: Frank R. Connors, The Villages, FL (US); Caroline M. Connors, The Villages, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/044,235

(22) Filed: Feb. 3, 2025

Related U.S. Application Data

(63) Continuation-in-part of application No. 18/798,146, filed on Aug. 8, 2024, now Pat. No. 12,285,108.

(51) Int. Cl.
*A47B 96/02* (2006.01)
*A47B 95/04* (2006.01)
*A47B 96/20* (2006.01)

(52) U.S. Cl.
CPC ..... *A47B 96/022* (2013.01); *A47B 95/04* (2013.01); *A47B 96/20* (2013.01); *A47B 2096/207* (2013.01)

(58) Field of Classification Search
CPC ... A47B 95/04; A47B 2096/207; A47B 96/20; A47B 96/02; A47B 2096/209; A47B 96/022; A47B 47/0058; A47B 96/024; A47B 96/061
See application file for complete search history.

(56) References Cited

U.S. PATENT DOCUMENTS

| | | | | |
|---|---|---|---|---|
| 1,599,654 | A | 9/1926 | Cranston | |
| 2,657,811 | A | 11/1953 | Isler | |
| 3,008,585 | A | 11/1961 | McNeill | |
| 5,349,134 | A | 9/1994 | Russell | |
| 5,588,370 | A | 12/1996 | Longley | |
| 7,255,236 | B1 | 8/2007 | Sauder et al. | |
| 7,987,535 | B1 * | 8/2011 | Tesch | A47K 3/286 297/14 |
| 8,857,109 | B1 * | 10/2014 | Kirby | A47K 3/282 4/578.1 |
| 9,402,476 | B2 * | 8/2016 | Crandall | A47K 3/281 |
| 9,439,510 | B2 * | 9/2016 | Karins, Sr. | A47B 96/021 |
| 2017/0347811 | A1 * | 12/2017 | Waid | A47B 96/024 |
| 2019/0190243 | A1 | 6/2019 | Mullen | |
| 2024/0098395 | A1 | 3/2024 | Berry | |

* cited by examiner

*Primary Examiner* — Ko H Chan
(74) *Attorney, Agent, or Firm* — Jason T. Daniel, Esq.; Daniel Law Offices, P.A.

(57) ABSTRACT

A shelf with interchangeable faceplates includes a shelf body having a top wall, a bottom wall and a pair of side walls that define an opening and an interior space. A pair of receptacles are positioned along each of the side walls and include inwardly oriented channels that are located adjacent to the opening. Each of the faceplates include indicia along a front surface and a guide panel along a back surface. Each of the faceplates are individually connectable to the shelf body by sliding the guide panel along the receptacles. When so positioned, the faceplate will cover the opening to block access to the interior space, and the indicia will be visible. Each of the interior space and the top wall of the main body include flat surfaces for independently storing any number of objects.

16 Claims, 5 Drawing Sheets

SHELF DEVICE WITH INTERCHANGEABLE FACEPLATE

CROSS-REFERENCE TO RELATED APPLICATIONS

This application is a continuation-in-part of and claims the benefit of U.S. application Ser. No. 18/798,146 filed on Aug. 8, 2024, the contents of which are incorporated herein by reference.

TECHNICAL FIELD

The present invention relates generally to storage devices, and more particularly to a shelf with an interchangeable decorative faceplate.

BACKGROUND

The statements in this section merely provide background information related to the present disclosure and may not constitute prior art.

Shelves are commonly utilized to receive and store any number of items within a home or office space. Shelves are typically hung from walls and are constructed as straight or corner units. In this regard, shelves typically comprise a single plank of material having an exposed top surface onto which items may be positioned. In this regard, the front portion of the shelf is typically unadorned, and has little to no aesthetic value.

However, there are times where it would be beneficial to provide a shelf having a storage area that is hidden so as to store items such as toilet paper or the like, for example. It would also be beneficial for the front portion of the shelf to include decorative elements which may be changed to suit different seasons or occasions.

The present invention, directed to a shelf device with interchangeable faceplate differs from the conventional art in a number of aspects. The manner by which will become more apparent in the description which follows, particularly when read in conjunction with the accompanying drawings.

SUMMARY OF THE INVENTION

The present invention is directed to a shelf with interchangeable faceplates. In one embodiment, the shelf body can have a top wall, a bottom wall and a pair of side walls that define an opening and an interior space. A pair of receptacles can be positioned along each of the side walls and can include inwardly oriented channels that are located adjacent to the opening.

In one embodiment, each of the faceplates can include indicia along a front surface and a guide panel along a back surface. Each of the faceplates can be individually connected to the shelf body by sliding the guide panel along the receptacles. When so positioned, the faceplate will cover the opening to block access to the interior space, and the indicia will be visible.

In one embodiment, each of the interior space and the top wall of the main body can include flat surfaces for independently storing any number of objects in one of a hidden or visible manner.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
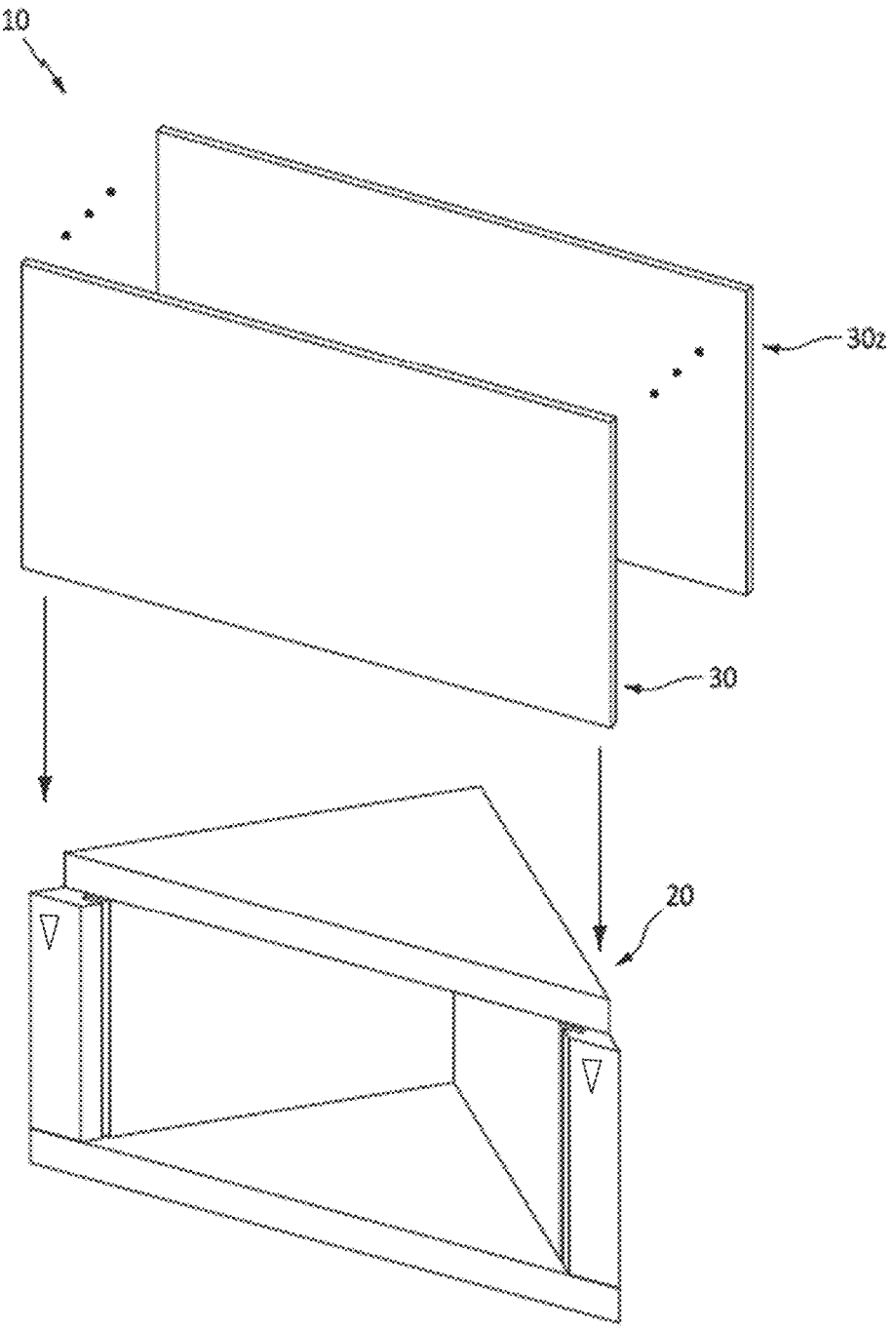
FIG. 1 is a perspective view of a shelf with interchangeable faceplate device that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described throughout this document, the term "about" "approximately" "substantially" and "generally" shall be used interchangeably to describe a feature, shape, or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described herein, the term "slidingly engage" and derivatives thereof shall be used to describe a situation wherein two identified objects are connected such that one identified part slides into or along the other identified part.

As described throughout this document, the term "complementary shape," and "complementary dimension,"

shall be used to describe a shape and size of a component that is identical to, or substantially identical to the shape and size of another identified component within a tolerance such as, for example, manufacturing tolerances, measurement tolerances or the like.

As described herein, the term "connector" includes any number of different elements that work alone or together to repeatedly join two items together in a nonpermanent manner. Several nonlimiting examples of connectors include, but are not limited to, flexible strips of interlocking projections with a slider (i.e., zipper), thread-to-connect, twist-to-connect, and push-to-connect type devices, opposing strips of hook and loop material (e.g., Velcro®), attractively oriented magnetic elements or magnetic and metallic elements, buckles such as side release buckles, clamps, sockets, clips, carabiners, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

FIGS. 1-5 illustrate one embodiment of a shelf device with interchangeable faceplate 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown at FIG. 1, the device 10 can include, essentially, a main body 20 and one or more faceplates 30-30*z* which can be removably positioned onto the main body.

Figure 2:
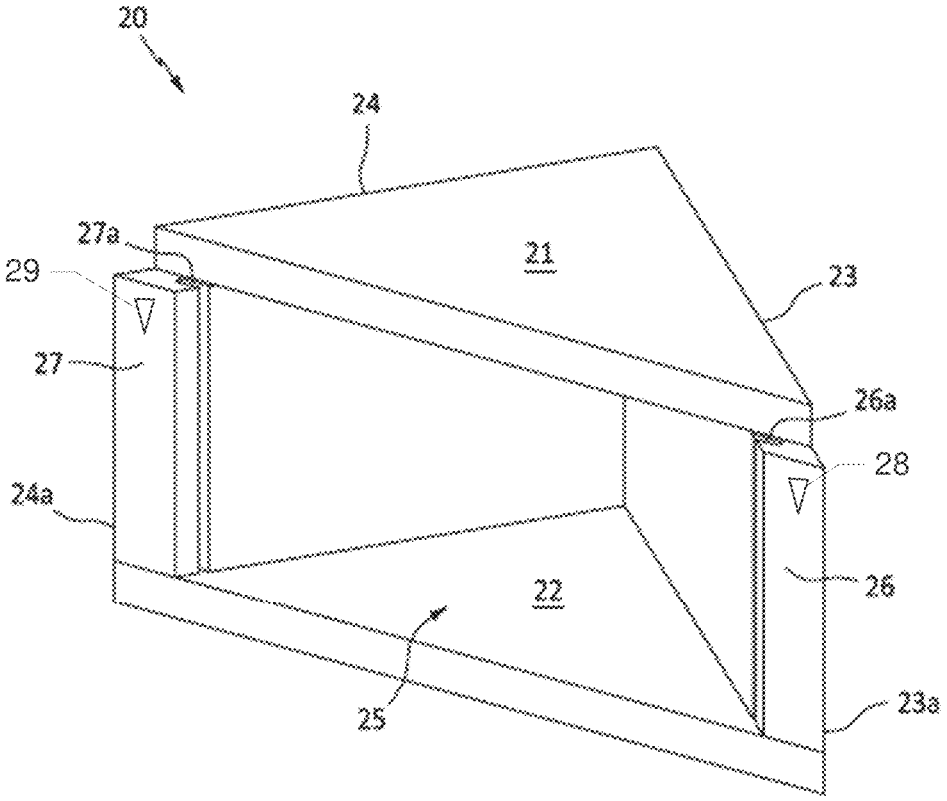
FIG. 2 is a perspective view of the main body of the shelf with interchangeable faceplates device in accordance with one embodiment of the invention.

As shown at FIG. 2, one embodiment of the main body 20 can include a top wall 21, a bottom wall 22, and a pair of side walls 23 and 24 that define a generally hollow interior storage space 25. In the illustrated embodiment, the top and bottom walls include triangular shaped elements so as to allow the device to comprise a corner unit for being mounted within the corner of a room.

As described herein, the body 20 may be formed from any number of different materials that are, for example, relatively strong and stiff for their weight. Several nonlimiting examples include but are not limited to various natural materials such as wood, various metals or metal alloys, plastics/polymers, and/or various composite materials. Additionally, the main body may be manufactured in any number of different sizes.

Although illustrated with regard to a corner unit, this is for illustrative purposes only, as other embodiments are contemplated wherein the walls include different shapes and/or alignments to create a different shaped shelf to be positioned at or along any number of other surfaces and locations. Moreover, any type of mounting hardware such as various wall anchors, screws, brackets, and the like may be provided for securing the main body onto a wall or other surface.

In one embodiment, a pair of shelf receptacles 26 and 27 can be positioned along the proximal ends 23*a* and 24*a* of the side walls 23 and 24, respectively. As shown, each of the receptacles can include a generally U or V-shaped channel 26*a* and 27*a* for engaging and receiving the ends of the guide panel 32 of the faceplate 30 via a sliding motion.

In one embodiment, a pair of slots 28 and 29 can be positioned along the front surface of the shelf receptacles 26 and 27, respectively. Each of the slots can function to receive the protrusions 37 and 38 in the below described faceplate when securing the faceplate onto the main body. In the preferred embodiment, each of the slots can include a generally triangular shape having sidewalls that gradually narrow from the top end to the bottom end. Of course, any number of other slots may be provided at any number of other locations along the main body and/or the shelf receptacles.

Figure 3A:
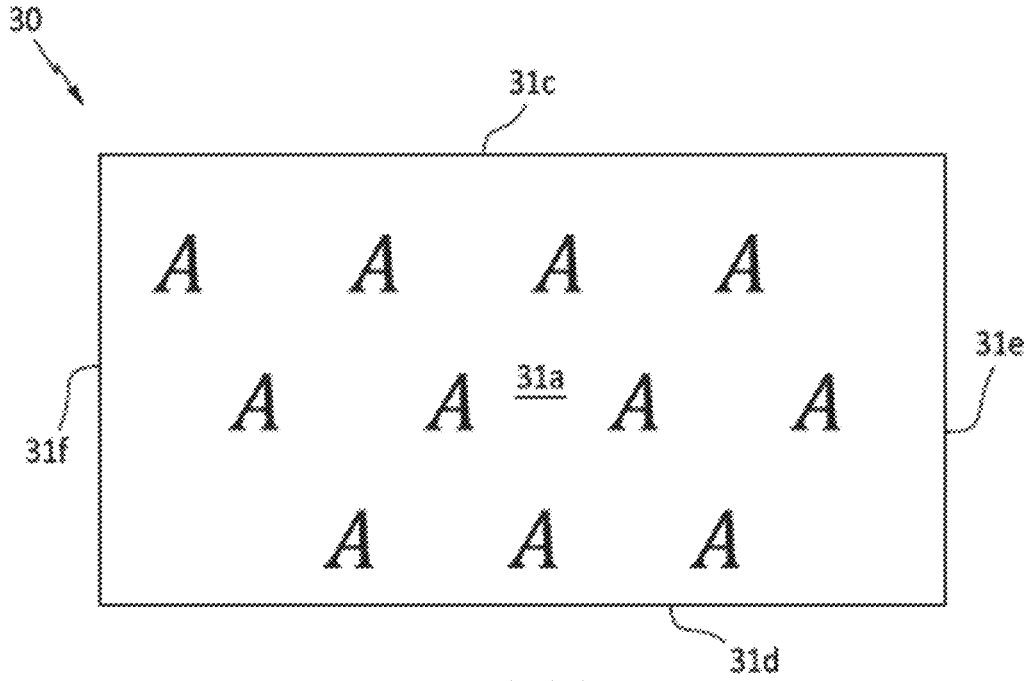
FIG. 3A is a front view of a faceplate of the shelf with interchangeable faceplates device, in accordance with one embodiment of the invention.
Figure 3B:
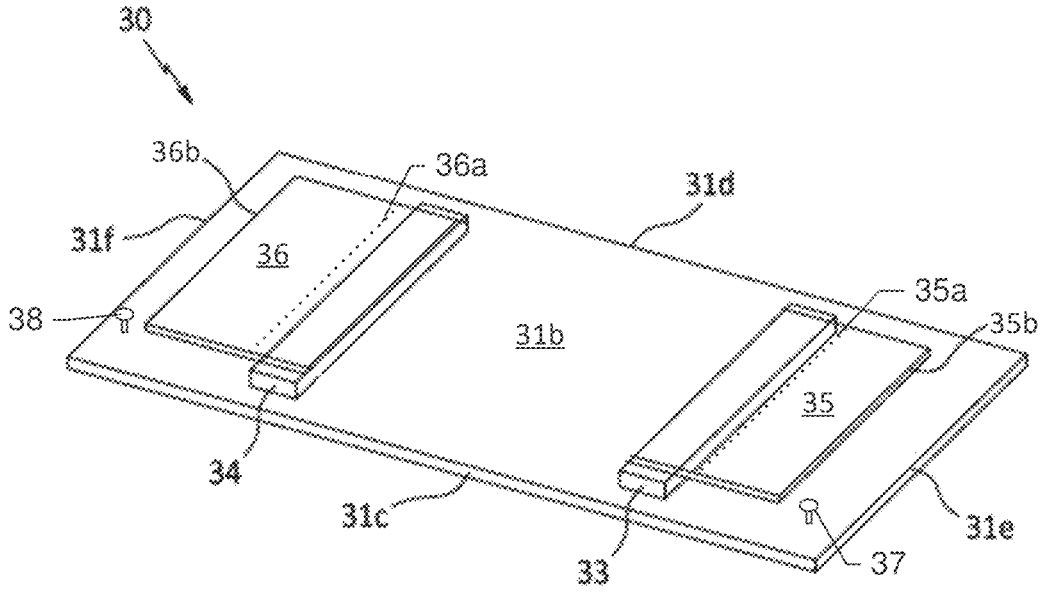
FIG. 3B is a back perspective view of a faceplate of the of the shelf with interchangeable faceplates device, in accordance with one embodiment of the invention.

FIGS. 3A and 3B illustrate one embodiment of a decorative faceplate 30 for use with the main body. As shown, the faceplate can include a generally planar member having a front surface 31*a*, a back surface 31*b*, a top edge 31*c*, a bottom edge 31*d* and a pair of side edges 31*e* and 31*f*.

In one embodiment, a pair of alignment guides 35 and 36 can be positioned parallel to the back surface 31*b* of the faceplate 30 via a pair of spacer blocks 33 and 34, respectively. In this regard, alignment guide 35 can be secured along the back surface of spacer block 33 and can extend outward therefrom toward side edge 31*e*. Likewise, alignment guide 36 can be secured along the back surface of spacer block 34 and can extend outward therefrom toward side edge 31*f*.

In one embodiment, each of the alignment guides (or a portion thereof) can be removably connected to the spacer blocks. In the preferred embodiment, each of the alignment guides 35 and 36 can include a pre-scored line 35*a* and 36*a*, respectively, that is positioned along the guide at a location adjacent to, and parallel with the outside edge of the spacer block to which the guide is secured. The scored lines functioning to allow a user to easily reduce or remove the alignment guides from the device by bending the guides along the scored line causing the material to separate.

In one embodiment, a pair of protrusions 37 and 38 can also be positioned along the back surface of the faceplate 31*b*. Each of the protrusions 37 and 38 can ideally include a wide outer surface and a narrow inner surface and can be inserted within the slots 28 and 29, respectively to secure the faceplate onto the main body. In this regard, the slots and protrusions may be utilized in conjunction with the alignment guides or in place of the alignment guides when the same have been removed via the scored lines. Of course, any number of other protrusions may be provided at any number of other locations to engage any number of other slots.

In either instance, any form of indicia "A" can be positioned along the front surface 31*a* of the faceplate. As described herein, the term "indicia" can include, comprise, or consist of any type of functional or non-functional decorative elements such as various colors/color patterns, markings, words, shapes, symbols, logos, designs, patterns, or images. The indicia can be imprinted onto the faceplate or may be constructed from a secondary material such as paper or canvas, for example that is secured onto and/or into the faceplate in accordance with known techniques. In either instance, the indicia "A" may be provided so as to be flush with the surface or can be raised/protruding outward from the surface to provide a three-dimensional effect.

Figure 4:
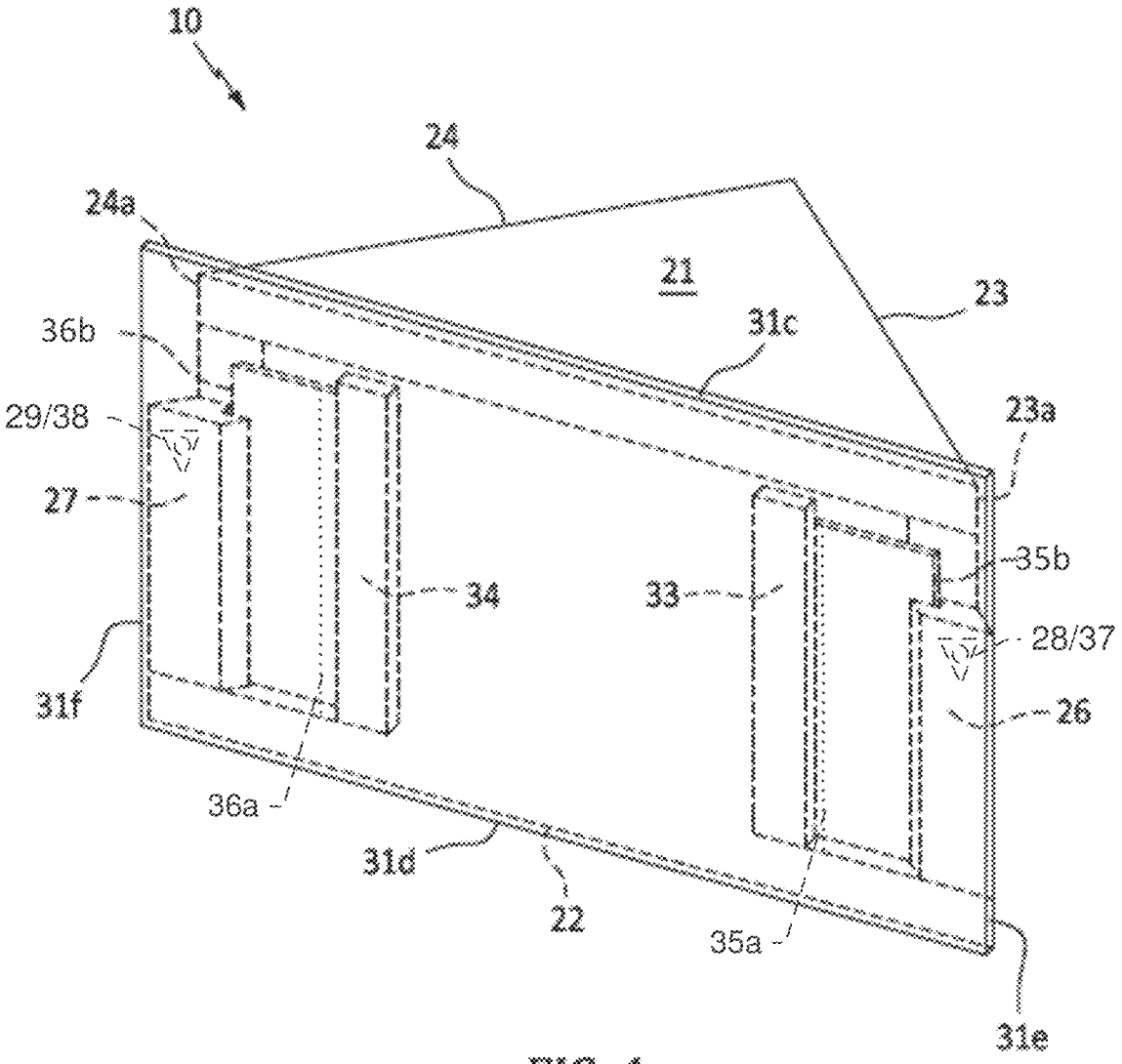
FIG. 4 is a front view of the shelf with interchangeable faceplates device in operation, in accordance with one embodiment of the invention.

As shown at FIG. 4, the faceplate can be positioned onto the main body by positioning and sliding the ends 35*b* and 36*b* of the guides into the channels 26*a* and 27*a* of the receptacles 26 and 27. The ends can move along the length of the receptacles until the protrusions 37 and 38 are aligned with the slots 28 and 29, respectively. When so positioned, the protrusions can be inserted within the slots, and the faceplate can continue to move downward until the bottom edges of the spacer blocks 33 and 34 make contact with the top surface of the bottom wall 22. At this time, the faceplate will be secured onto the main body such that objects within the interior space will not be visible.

Figure 5:
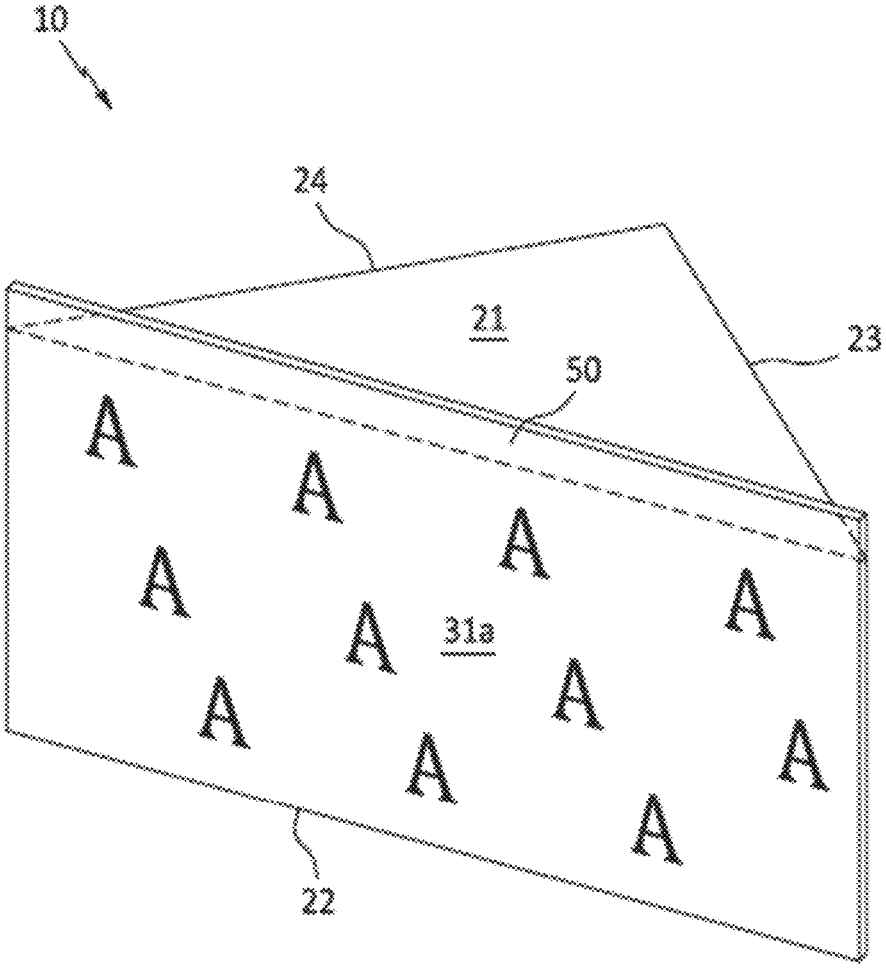
FIG. 5 is another front view of the shelf with interchangeable faceplates device in operation, in accordance with one embodiment of the invention.

In the preferred embodiment, the faceplate will include a width (e.g., distance between side edges 31*e* and 31*f*) that is complementary to the width of the main body (e.g., distance between the proximal ends of the side walls 23 and 24). Likewise, the faceplate can include a height (e.g., distance between the top and bottom walls 31*c* and 31*d*) that is equal to the height of the main body (e.g., proximal ends of the top wall and bottom wall 21 and 22) so as to be flush with the top wall of the main body as shown at FIG. 4, or may be or greater than the height of the main body so as to create a raised lip section 50 as shown at FIG. 5.

In either instance, any number of secondary objects may be positioned and stored within the interior space of the main body. When so positioned, these objects will be hidden by the decorative faceplate and can be retrieved by simply lifting and removing the faceplate from the main body. Likewise, any number of other objects may be placed on the top wall of the main body so as to be viewed simultaneously with the decorative faceplate. Finally, the user can switch faceplates at any time to display different indicia on other faceplates to suit any occasion, event, or holiday season, for example.

Although described above with regard to a pair of receptacles that engage an alignment device via a sliding motion, this is but one possible means for securing the faceplate(s) onto the main body. To this end, other embodiments are contemplated wherein the faceplate is removably secured onto the main body via one or more different types of connectors that are positioned along the back surface of the faceplate and/or the walls of the main body.

As to a further description of the manner and use of the present invention, the same should be apparent from the above description. Accordingly, no further discussion relating to the manner of usage and operation will be provided.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A shelf, comprising:

a main body having a top wall, a bottom wall and a pair of side walls that define an opening and an interior space;

at least one faceplate having a front surface, a back surface and a plurality of edges;

each of the at least one faceplate having a pair of alignment guides that are positioned parallel to the back surface of the faceplate; and a pair of spacer blocks that are positioned between the pair of alignment guides and the back surface of the faceplate, wherein each of the at least one faceplate includes a shape and size that is complementary to a shape and a size of the opening, and wherein each of the at least one faceplate is configured to be slidingly connected to the main body via the pair of alignment guides.

2. The shelf of claim 1, wherein the top wall and the bottom wall include triangular shapes.

3. The shelf of claim 2, wherein a back edge of each of the pair of sidewalls are joined together, and wherein the main body is configured to be secured onto a corner location of a wall.

4. The shelf of claim 1, wherein at least a portion of each of the pair of alignment guides are removably connected to the pair of spacer blocks.

5. The shelf of claim 1, wherein each of the at least one faceplate is configured to block each of the opening and the interior space of the main body, when the faceplate is secured onto the main body.

6. The shelf of claim 5, wherein each of the at least one faceplate does not block the opening of the main body or the interior space when the faceplate is not secured onto the main body.

7. The shelf of claim 1, wherein each of the at least one faceplate includes indicia.

8. The shelf of claim 1, wherein the at least one faceplate comprises multiple faceplates.

9. The shelf of claim 1, wherein the interior space includes a flat surface that is configured to receive and store an object.

10. The shelf of claim 9, wherein the top wall includes a flat surface that is configured to receive and store another object.

11. The shelf of claim 1, further comprising:

a pair of shelf receptacles that are positioned along the main body.

12. The shelf of claim 11, wherein each of the pair of shelf receptacles extend upward from a top surface of the bottom wall of the main body at a location adjacent to a front surface of the pair of side walls.

13. The shelf of claim 12, wherein each of the pair of shelf receptacles includes a channel for slidingly receiving one of the pair of alignment guides.

14. The shelf of claim 1, further comprising:

a pair of slots that are positioned along the main body.

15. The shelf of claim 14, wherein each of the at least one faceplate includes a pair of protrusions.

16. The shelf of claim 15, wherein the pair of protrusions are configured to be secured within the pair of slots to secure the faceplate to the main body.

* * * * *